US008562510B2

(12) United States Patent
Koch

(10) Patent No.: US 8,562,510 B2
(45) Date of Patent: Oct. 22, 2013

(54) INCUBATOR OR OPEN PATIENT CARE UNIT WITH AUTOMATICALLY ACTUATED SIDE PANES

(75) Inventor: Jochim Koch, Ratzeburg (DE)

(73) Assignee: Dräger Medical GmbH, Lübeck (DE)

( * ) Notice: Subject to any disclaimer, the term of this patent is extended or adjusted under 35 U.S.C. 154(b) by 1735 days.

(21) Appl. No.: 11/862,556

(22) Filed: Sep. 27, 2007

(65) Prior Publication Data

US 2008/0081943 A1 Apr. 3, 2008

(30) Foreign Application Priority Data

Sep. 29, 2006 (DE) ..... 10 2006 046 466

(51) Int. Cl.
*A61G 11/00* (2006.01)

(52) U.S. Cl.
USPC ..... 600/22

(58) Field of Classification Search
USPC ..... 600/21, 22; 128/20.12; 49/363, 169
See application file for complete search history.

(56) References Cited

U.S. PATENT DOCUMENTS

| | | | | |
|---|---|---|---|---|
| 5,177,900 | A * | 1/1993 | Solowiej | 49/363 |
| 5,810,709 | A | 9/1998 | Simenauer et al. | |
| 6,024,694 | A | 2/2000 | Goldberg et al. | |
| 6,560,926 | B1 * | 5/2003 | Gillett | 49/169 |

FOREIGN PATENT DOCUMENTS

| | | |
|---|---|---|
| DE | 35 33 271 C2 | 2/1991 |
| DE | 696 35 498 T2 | 8/2006 |
| EP | 1 106 160 B1 | 6/2001 |

* cited by examiner

*Primary Examiner* — Christine Matthews
(74) *Attorney, Agent, or Firm* — McGlew and Tuttle, P.C.

(57) ABSTRACT

An incubator or open patient care unit (1) is provided, which can be opened and closed by one or more side panes (2). The side pane (2) or each side pane (2) is equipped with essentially vertical guide elements (3, 4). A drive (10) may be provided with an associated analysis unit (11) for the drive (10), wherein the analysis unit (11) receives sensor and/or switching signals, so that the side pane (2) can be automatically opened and/or closed by a preset time or sensor signal.

19 Claims, 3 Drawing Sheets

INCUBATOR OR OPEN PATIENT CARE UNIT WITH AUTOMATICALLY ACTUATED SIDE PANES

CROSS REFERENCE TO RELATED APPLICATIONS

This application claims the benefit of priority under 35 U.S.C. §119 of German Patent Application DE 10 2006 046 466.4 filed Sep. 29, 2006, the entire contents of which are incorporated herein by reference.

FIELD OF THE INVENTION

The present invention pertains to an incubator for an open patient care unit, which can be opened and closed by means of one or more side panes.

BACKGROUND OF THE INVENTION

Incubators have hitherto been provided, in general, with a hood covering a reclining surface and side panes with flaps. Open patient care units are equipped, in general, with heat radiation means for the reclining surface. So-called hybrids have a vertically movable covering hood with heat radiation means, so that either the state of a classical incubator or that of an open patient care unit can be established with a single arrangement.

Various suggestions have become known in the past years to open and to close the side walls of incubators and open patient care units, as this is described as an example in U.S. Pat. No. 5,810,709 and EP 1 106 160 B1.

Hinges are used in the embodiments that have become known so far to pivot the transparent side flaps upward or downward. The drawback of side flaps, which are folded down, is that the inner sides of the side flaps are touched by the clothing of the care provider in the opened state and thus they may become contaminated, so that the microorganisms may reach the patient in the incubator or in the care unit in the reclosed state of the side flaps. Another drawback arises from the fact that the side flaps are pulled downward by the force of gravity and may fall down when being opened and generate noise or even vibrations and shocks that affect the small patients.

The problem in case of side flaps that can be pivoted and folded upward about a horizontal axis onto the hood of the incubator is that these side flaps may interfere with the visible area in the opened state. They are likewise pulled downward by the force of gravity during closing and may cause loud disturbing noise or likewise shocks the patient as a result.

Side flaps that can be folded about a vertical axis likewise have not really proved successful, either, because the opened side flaps are in the way of the care provider on the left and right of the incubator hood and possibly block other therapy or monitor devices standing next to the thermotherapy device.

SUMMARY OF THE INVENTION

Consequently, the object of the present invention is to propose an improved incubator or an improved open patient care unit with side panes that can be opened and closed, which can be handled without problems in respect to accessibility to the patient and do not compromise the patient.

The object is accomplished with the features of claim 1. The subclaims show preferred embodiments and variants of the incubator or the open patient care unit according to claim 1.

The incubator or the open patient care unit according to the invention utilizes the advantage that arises from the fact that the side panes are opened or closed automatically and move up or down on an essentially vertical line in parallel to the large side pane surfaces. This is carried out manually or preferably with drives that are known per se, for example, with electrically driven linear or stepping motors with bowden cable. The opening and closing can be carried out very rapidly with such drive motors in case of an emergency or also very slowly and quietly for normal use.

When the care provider wants, e.g., to treat the patient and had therefore disinfected his hands before, the side pane can be automatically activated during this time by a corresponding time or actuation signal for lowering. After the end of the care procedure at the patient, the side pane can be raised again slowly.

The side panes may also be raised again automatically after a predetermined time should the care provider have forgotten to send a switching signal. The automatic closing may take place, for example, after a vibration analysis of corresponding audio sensor signals measured by means of a sensor. As soon as the measured vibrations at the incubator or at the open patient care unit has declined to a predetermined minimum, the intercalated analysis unit assumes, for example, that no more care procedures are taking place any more at this given point in time, so that the drive of the side pane is actuated for raising.

Alternative detectable sensor signals to the analysis unit are supplied, for example, by proximity or motion switches with infrared sensors, which detect the motion or the presence or the absence of the care provider.

A protective function is preferably also installed when the side panes are being raised to ensure that no one can get stuck:

Getting stuck by body parts, tubes or other parts can be recognized by measuring the torque of the drive motor, the velocity of adjustment or corresponding measured variables, so that the analysis unit turns the drive off immediately or lets it move back if necessary.

For quick access to the patient, for example, in case of an emergency, in case of failure of mechanical systems or power failure, the guide mechanism of the side pane preferably has a very simple mechanical pivoting device with a hinge and with a locking mechanism, so that the panes can be opened and closed manually if needed when such an emergency presents itself.

The pivoting device with locking mechanism is always raised and lowered with the particular side pane and is available in every height position of the side pane. The pivoting device with locking mechanism may also be used to clean the rear side or the inner side of the side pane when access is otherwise difficult.

An exemplary embodiment of the present invention will be explained below on the basis of the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
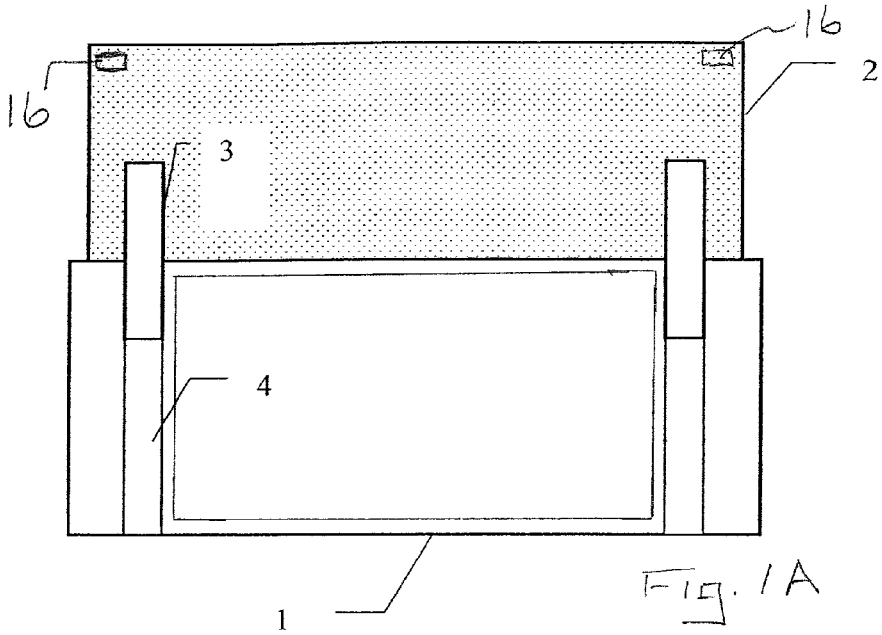
FIG. 1A is a schematic side view showing a general layout and function of an incubator or of an open patient care unit with side pane, showing the side pane in an open state.

Referring to the drawings in particular an incubator or an open patient care unit 1, which is shown in outline, has a reclining surface for the patient and an access opening. A side pane 2 is fixed to the incubator or an open patient care unit 1, according to FIGS. 1A and 1B, on the left and right by means of two lateral brackets 3. The brackets 3 run on parallel rails 4 and form the guide elements or the guide mechanism for moving the side pane 2 to open and close the access opening. The brackets 3 are raised and lowered by means of a drive 10 by an electric motor to raise and lower side pane 2 to move side pane 2 from a closed position (FIG. 1B) to an open position (FIG. 1A).

Figure 2:
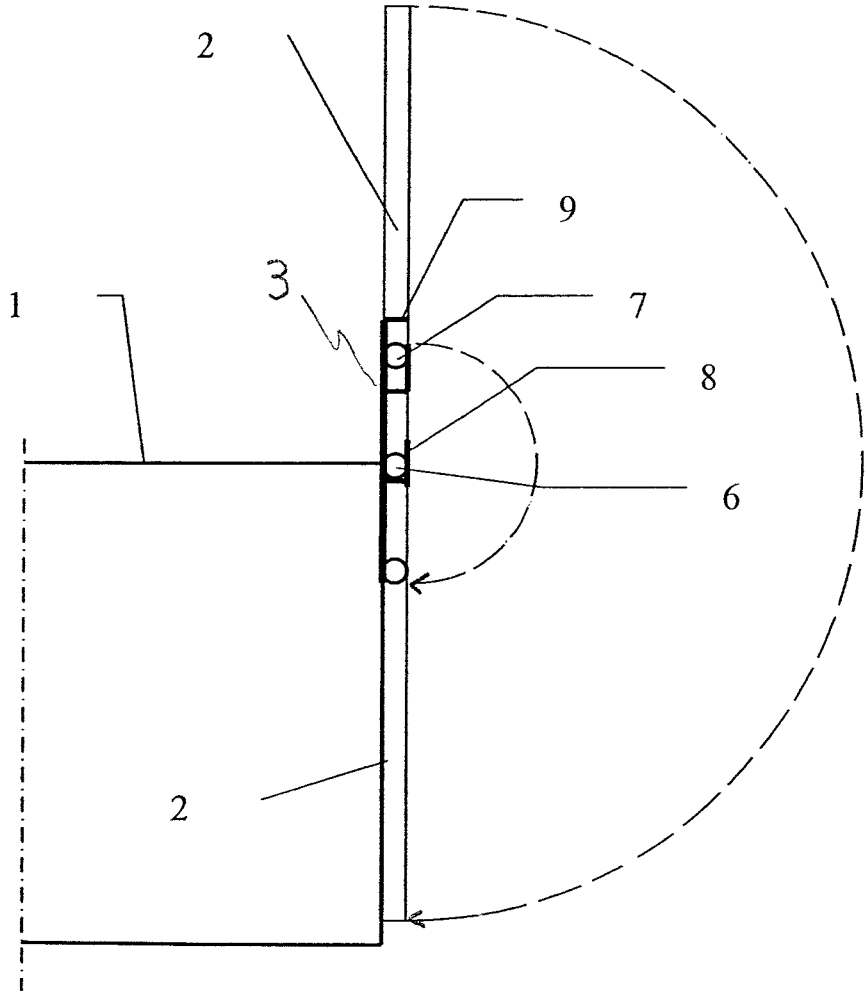
FIG. 2 is the general layout and function view of a pivoting device with locking mechanism for a side pane of an incubator or of an open patient care unit.

For emergencies, when no electricity or pneumatic energy is available or the opening operation takes too long, the side pane 2 can also be folded down manually according to FIG. 2. The side pane 2 is additionally guided for this via a hinge 8 of the brackets 3. The hinge 8 has a horizontal axis 6 and is held in the catch 9 by means of the parallel upper additional axis 7. By briefly raising the side pane 2 manually, the additional axis 7 can be lifted out of the catch 9 if necessary. The side pane 2 can then be pivoted vertically downward.

Figure 1B:
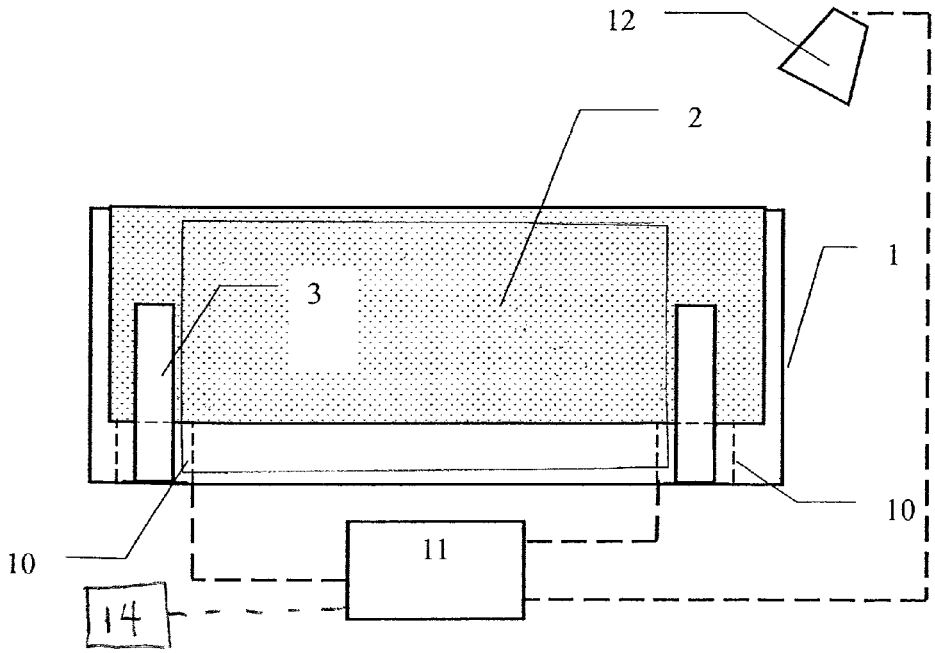
FIG. 1B is a schematic side view showing a general layout and function of the incubator or open patient care unit of FIG. 1A, showing the side pane in a closed state and also showing additional components.

The analysis unit (control unit) 11 in the device according to FIG. 1B receives sensor signals, for example, from an infrared sensor 12, which detects the motion of a member of the care provider or from an audio sensor 14 which detects the audio input of the care provider, and the drive 10 is controlled by the analysis unit 11 for raising or lowering the side pane 2 as a function of the sensor signals received. The analysis unit 11 may additionally or alternatively also be set with predetermined or preset time limits for the actuation of motor to move the side panes 2.

The side pane 2 may be equipped with one or more grip elements 16, preferably in the upper edge area for better manual actuation.

Figure 3A:
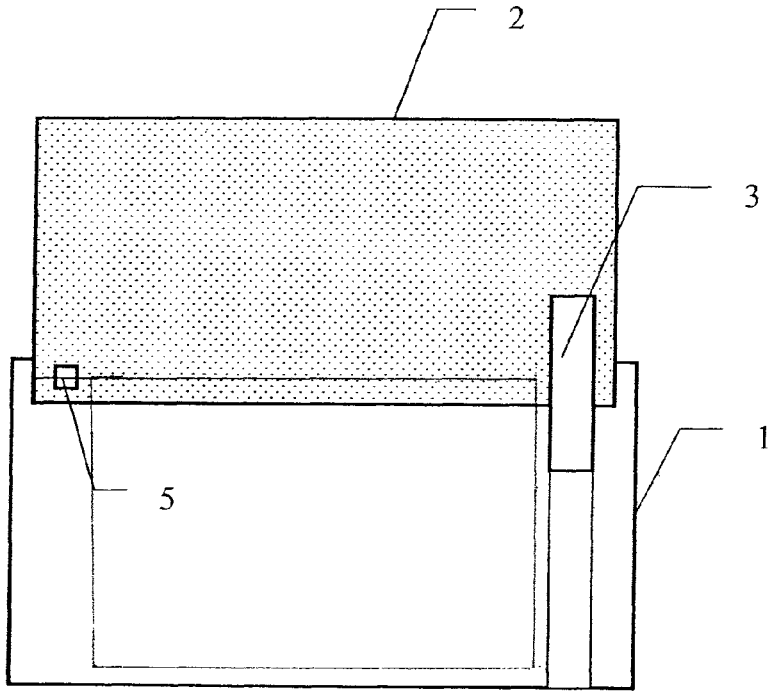
FIG. 3A is a schematic side view showing a general layout and function of an incubator or of an open patient care unit with side pane according to an alternative embodiment to that shown in FIG. 1, showing the side pane in an open state.
Figure 3B:
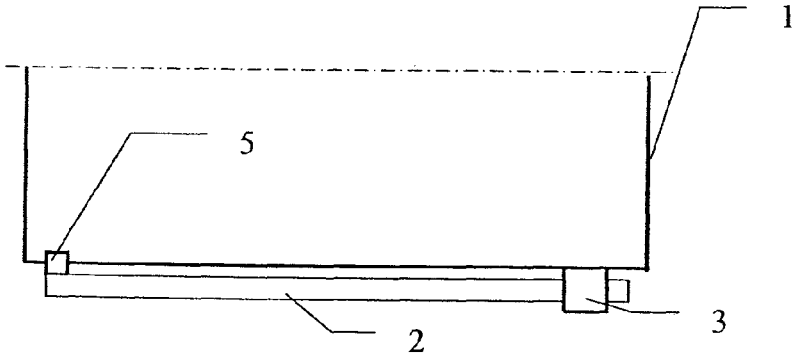
FIG. 3B is a schematic partial top view showing of the incubator or open patient care unit with side pane according to an alternative embodiment of FIG. 3.

As an alternative, the embodiment may also be designed according to FIGS. 3A and 3B such that it makes do with a guide mechanism in the form of only a single lateral bracket 3 for a side pane 2. If a central arrangement is not desired, especially in order not to block the view to the patient, the guide mechanism may be arranged on one side, as is shown in FIG. 3A. The side pane 2 may be somewhat prestressed on the side without the guide mechanism. For this, a small roller 5 may be present on the side that is provided with no lateral bracket 3. The side pane 2 rolls along the small roller 5 as shown in FIG. 3B. With the roller 5, the side pane 2 is in contact in every position and can be moved with little friction and wear without jamming.

While specific embodiments of the invention have been shown and described in detail to illustrate the application of the principles of the invention, it will be understood that the invention may be embodied otherwise without departing from such principles.

What is claimed is:

1. A neonatal incubator comprising: a neonatal incubator housing comprising a neonatal incubator enclosure comprising side walls and end walls with an opening in one of said side walls; a neonate patient reclining surface within said enclosure of said neonatal incubator housing, said neonatal incubator enclosure enclosing said neonate patient reclining surface, said side walls extending adjacent to respective sides of said neonate patient reclining surface, except for a side of said neonate patient reclining surface adjacent to said opening and said end walls extending adjacent to respective ends of said neonate patient reclining surface; a side pane having a pane surface, the opening being opened and closed by means of said side pane; essentially vertical guide elements for vertical transport of said side pane in a direction in parallel to the pane surface, the guide elements comprising a guide rail provided on said housing adjacent to said opening and a bracket connected to said side pane for movement along said guide rail, said guide rail running essentially vertically; a drive for driving said side pane along said guide elements between an open and a closed position; and an analysis unit for controlling said drive, wherein said analysis unit receives at least one of sensor and switching signals and automatically opens and closes said side pane by a preset time or sensor signal.

2. A neonatal incubator in accordance with claim 1, further comprising a motion switch wherein the sensor signal is sent by said motion switch to said analysis unit.

3. A neonatal incubator in accordance with claim 1, further comprising a touchless motion switch wherein the sensor signal is sent by said touchless motion switch.

4. A neonatal incubator in accordance with claim 3, wherein said touchless motion switch is an infrared or proximity switch.

5. A neonatal incubator in accordance with claim 1, further comprising: an audio sensor wherein the sensor signal is sent by said audio sensor.

6. A neonatal incubator in accordance with claim 1, wherein said vertical guide elements further comprise another guide rail provided on said housing adjacent to said opening and another bracket for movement along said another guide rail, said another guide rail running essentially vertically, said side pane being connected to said another bracket for the vertical transport of said side pane in a direction in parallel to the pane surface and between an open position and a closed position, said pane surface covering said opening in said closed position and allowing access to a patient at said reclining surface in said open position.

7. A neonatal incubator or neonatal open patient care unit in accordance with claim 6, wherein each of said brackets includes a mechanical pivoting device with a releasable locking mechanism, allowing a pivoting of said pane from an open position into a closed position.

8. A neonatal incubator in accordance with claim 1, wherein said guide elements are arranged on only one side of said side pane.

9. A neonatal incubator in accordance with claim 1, further comprising a grip element on said side pane for manual movement of said side pane from the open to the closed position, said grip element being arranged in an upper edge area of said side pane.

10. A neonatal incubator comprising:

a neonatal incubator housing comprising a neonate patient reclining surface and a neonatal incubator enclosure comprising side panels enclosing said neonate patient reclining surface at sides of said reclining surface, said side panels including side panels extending adjacent to respective sides of said neonate patient reclining surface and side panels extending adjacent to respective ends of said neonate patient reclining surface, said neonatal incubator enclosure being provided with an access opening providing access, through one of said side panels, that extends adjacent to one of said sides of said neonate patient reclining surface, to said neonate reclining surface, from outside of said neonatal incubator enclosure; a side pane having a pane surface;

a guide rail provided on said one of said side panels, that extends adjacent to said one of said sides of said neonate patient reclining surface, of said housing; and a bracket for movement along said guide rail, said guide rail running essentially vertically, said side pane being connected to said bracket for vertical transport of said side pane in a direction in parallel to the pane surface and between an open position and a closed position, said pane surface covering said opening in said closed position and allowing access to a neonate patient at said neonate patient reclining surface in said open position wherein said bracket includes a mechanical pivoting device with a releasable locking mechanism, allowing a pivoting of said pane to close the opening.

11. A neonatal incubator in accordance with claim 10, further comprising:

a drive for driving said side pane along said guide rail between said open position and said closed position.

12. A neonatal incubator in accordance with claim 11, further comprising:

a control unit for controlling said drive, wherein said control unit receives sensor and/or switching signals and automatically opens and/or closes said side pane by a preset time and/or sensor signal.

13. A neonatal incubator in accordance with claim 12, further comprising a motion switch wherein the sensor signal is sent by said motion switch to said control unit.

14. A neonatal incubator in accordance with claim 12, further comprising a touchless motion switch wherein the sensor signal is sent by said touchless motion switch.

15. A neonatal incubator in accordance with claim 14, wherein said touchless motion switch is an infrared or proximity switch.

16. A neonatal incubator in accordance with claim 12, further comprising: an audio sensor wherein the sensor signal is sent by said audio sensor.

17. A neonatal incubator in accordance with claim 10, wherein said guide rail is arranged on only one side of said side pane.

18. A neonatal incubator or neonatal open patient care unit in accordance with claim 10, further comprising a grip element on said side pane for manual movement of said side pane from the open position to the closed position, said grip element being arranged in an upper edge area of said side pane.

19. A neonatal incubator comprising: a neonatal incubator housing comprising a neonate patient reclining surface and a neonatal incubator enclosure comprising side panels including side panels extending adjacent to respective sides of said neonate patient reclining surface and side panels extending adjacent to respective ends of said neonate patient reclining surface, said side panels extending upwardly from a level of said neonate patient reclining surface and enclosing said neonate patient reclining surface at sides thereof, said enclosure being provided with an access opening providing access, at one of said side panels of said neonatal incubator housing that extends adjacent to one of said sides of said neonate patient reclining surface, to said neonate patient reclining surface from outside of said enclosure, said access opening having an access opening plane; a side pane having a pane surface; a guide rail provided on said one of said side panels, that extends adjacent to said one of said sides of said neonate patient reclining surface, of said housing; and a bracket for movement along said guide rail, said guide rail running essentially vertically, said side pane being connected to said bracket for vertical transport of said side pane in a direction in parallel to said opening plane and between an open position and a closed position, said pane surface covering said opening in said closed position and allowing access to a neonate patient at said neonate patient reclining surface in said open position; and another guide rail provided on said one of said side panels, that extends adjacent to one of said sides of said neonate patient reclining surface, of said housing and another bracket for movement along said another guide rail, said guide rail being arranged on one side of said side pane and said another guide rail being arranged on another side of said side pane.

* * * * *